US009771790B2

(12) United States Patent
Clark et al.

(10) Patent No.: US 9,771,790 B2
(45) Date of Patent: Sep. 26, 2017

(54) DOWNHOLE MEASUREMENT ASSEMBLY, TOOL AND METHOD

(71) Applicant: National Oilwell DHT, L.P., Houston, TX (US)

(72) Inventors: Kevin Clark, Montgomery, TX (US); Joshua Tutt, Magnolia, TX (US)

(73) Assignee: NATIONAL OILWELL DHT, L.P., Houston, TX (US)

( * ) Notice: Subject to any disclaimer, the term of this patent is extended or adjusted under 35 U.S.C. 154(b) by 420 days.

(21) Appl. No.: 14/383,531

(22) PCT Filed: Feb. 20, 2013

(86) PCT No.: PCT/US2013/026926
§ 371 (c)(1),
(2) Date: Sep. 5, 2014

(87) PCT Pub. No.: WO2013/138034
PCT Pub. Date: Sep. 19, 2013

(65) Prior Publication Data

US 2015/0021093 A1 Jan. 22, 2015

Related U.S. Application Data

(60) Provisional application No. 61/612,073, filed on Mar. 16, 2012.

(51) Int. Cl.
*E21B 47/007* (2012.01)
*E21B 47/06* (2012.01)
(Continued)

(52) U.S. Cl.
CPC ..... *E21B 47/06* (2013.01); *E21B 12/00* (2013.01); *E21B 17/16* (2013.01); *E21B 47/0006* (2013.01); *E21B 47/01* (2013.01)

(58) Field of Classification Search
CPC ..... E21B 47/06; E21B 12/00; E21B 17/16; E21B 47/01; E21B 47/006
See application file for complete search history.

(56) References Cited

U.S. PATENT DOCUMENTS 3,686,942 A 8/1972 Chatard et al.
3,827,294 A 8/1974 Anderson
(Continued)

FOREIGN PATENT DOCUMENTS

WO 0123853 4/2001
WO 2013138034 9/2013

OTHER PUBLICATIONS

Examination Report for Canadian Patent Application No. 2,866,653 dated Oct. 23, 2015, 4 pages.
(Continued)

*Primary Examiner* — Jennifer H Gay
*Assistant Examiner* — Steven MacDonald
(74) *Attorney, Agent, or Firm* — Conley Rose, P.C.

(57) ABSTRACT

A downhole measurement assembly, tool, and method is provided. The downhole measurement assembly includes at least one drill collar 220 having at least one compensation portion and at least one force portion with a load path 239 therethrough. The compensation portion has a different dimension from the force portion. The assembly also includes a plurality of compensation sensors 230.1, 230.2 positionable about the compensation portion to measure downhole tool pressures applied thereto, and a plurality of force sensors 230.3, 230.4 positionable about the force portion to measure downhole forces applied thereto. The compensation sensors and the force sensors are positionable about the drill collar(s) 220 in a strain configuration along
(Continued)

the load path 239 whereby the measured downhole tool pressure is isolatable from the measured downhole forces on the drill collar(s).

28 Claims, 4 Drawing Sheets

(51) Int. Cl.

| | |
|---|---|
| ***E21B 47/00*** | (2012.01) |
| ***E21B 47/01*** | (2012.01) |
| ***E21B 17/16*** | (2006.01) |
| ***E21B 12/00*** | (2006.01) |

(56) References Cited

U.S. PATENT DOCUMENTS

| | | | |
|---|---|---|---|
| 3,876,972 | A | 4/1975 | Garrett |
| 3,968,473 | A | 7/1976 | Patton et al. |
| 4,359,898 | A | 11/1982 | Tanguy et al. |
| 5,386,724 | A | 2/1995 | Das et al. |
| 6,068,394 | A | 5/2000 | Dublin, Jr. |
| 6,408,861 | B1 | 6/2002 | Ortega |
| 6,427,530 | B1 | 8/2002 | Krueger et al. |
| 6,547,016 | B2 | 4/2003 | Wassell |
| 6,575,025 | B1 | 6/2003 | Demia |
| 6,802,215 | B1 | 10/2004 | Boucher et al. |
| 6,957,575 | B2 | 10/2005 | Boucher et al. |
| 7,503,403 | B2 | 3/2009 | Jogi et al. |
| 7,757,552 | B2 | 7/2010 | Bogath et al. |
| 7,775,099 | B2 | 8/2010 | Bogath et al. |
| 2002/0070050 | A1 | 6/2002 | Wassell |
| 2011/0024188 | A1 | 2/2011 | Wassell et al. |

OTHER PUBLICATIONS

Examination Report for United Kingdom Patent Application No. GB1415739.0 dated Oct. 7, 2015, 3 pages.

Examination Report for UK Patent Application No. GB1415739.0 dated Oct. 2, 2014, 1 page.

International Search Report for PCT Application No. PCT/US2013/026926 dated Mar. 1, 2014, 5 pages.

International Preliminary Report on Patentability and Written Opinion for PCT Application No. PCT/US2013/026926 dated Sep. 16, 2014, 8 pages.

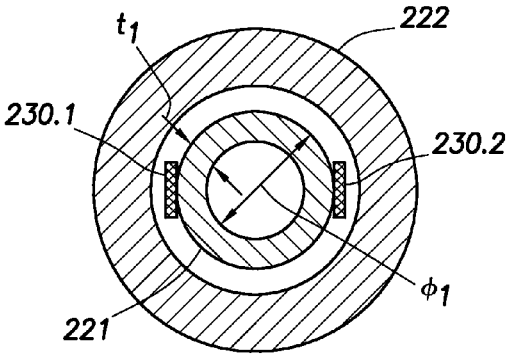
FIG.3.1
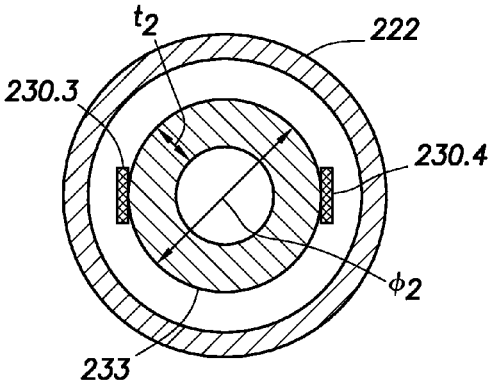
FIG.3.2
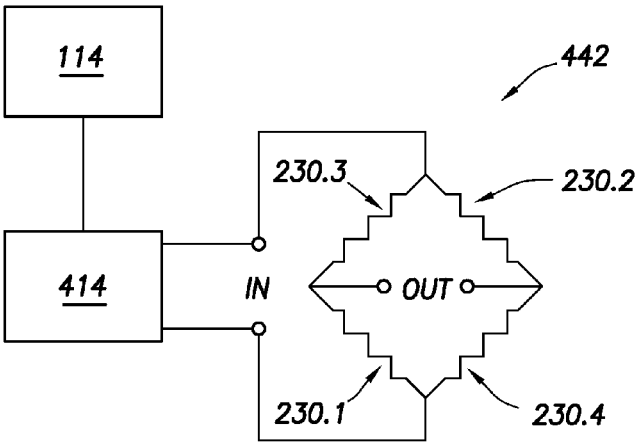
FIG.4

DOWNHOLE MEASUREMENT ASSEMBLY, TOOL AND METHOD

BACKGROUND

This disclosure relates generally to techniques for performing wellsite operations. More specifically, the disclosure relates to techniques for measuring downhole parameters, such as weight on bit (WOB).

In the oil and gas exploration and production industry, subsurface formations are accessed by drilling wellbores from the surface. A drill bit is mounted on the lower end of a tubular string of pipe (referred to as a "drill string"), and advanced into the earth from the surface to form a wellbore. A bottom hole assembly (BHA) is provided along the drill string to perform various downhole operations, such as providing power to the drill bit to drill the wellbore and performing downhole measurements. Drilling fluid or "mud" may be pumped down through the drill string from the surface, and exited through nozzles in the drill bit. The drilling fluid may carry drill cuttings out of the wellbore, and back up to the surface through an annulus between the drill string and the wellbore wall.

During or after drilling, the drill string may be removed and other downhole tools, such as testing, perforating, injection, production and other tools and/or tubing may be positioned in the well to perform downhole operations. During such downhole operations, it may be desirable to measure downhole parameters, such as forces acting on the downhole tool and/or bit, downhole pressures (internal and/or external), torque on bit (TOB), weight on bit (WOB), etc. WOB refers to weight that is applied to the bit, for example, from the BHA and/or surface equipment.

Measurement of downhole parameters, such as WOB, may be useful in performing downhole operations. WOB may be used, for example, to steer drilling and/or to adjust drilling rates, bit penetration, bit wear, etc. Examples of various techniques for measuring downhole parameters, such as WOB, are provided in U.S. Pat. Nos. 6,802,215 and 6,957,575.

SUMMARY

In at least one aspect, the present disclosure relates to a downhole measurement assembly of a downhole tool positionable in a wellbore penetrating a subterranean formation. The downhole tool has a bottom hole assembly with a drill bit at an end thereof deployable into the wellbore on a drill string. The downhole measurement assembly includes at least one drill collar having at least one compensation portion and at least one force portion with a load path therethrough. The compensation portion has a different dimension from the force portion. The assembly also includes a plurality of compensation sensors positionable about the compensation portion to measure downhole tool pressures applied thereto, and a plurality of force sensors positionable about the force portion to measure downhole forces applied thereto. The compensation sensors and the force sensors are positionable about the drill collar in a strain configuration along the load path whereby the measured downhole tool pressure is isolatable from the measured downhole forces on the at least one drill collar.

The strain configuration may be a Wheatstone bridge. The force sensors are at a force depth about the force portion and the compensation sensors are at a compensation depth about the compensation portion. The force sensors and the compensation sensors are strain gauges. The drill collar includes a plurality of drill collars, with the compensation portion about a first of the drill collars and the force portion about a second of the drill collars. The compensation and force sensors may be positionable between the first and the second of the drill collars. The force sensors may be positionable about an outer surface of the second of the drill collars. The downhole measurement assembly may also have gaskets between the drill collars. The compensation and the force sensors may be positioned on opposite sides of the at least one drill collar. The compensations sensors and the force sensors may be aligned or offset about the drill collar. The drill collar has a plurality of cavities for receiving the compensation sensors and the force sensors.

In another aspect, the disclosure relates to a downhole tool positionable in a wellbore penetrating a subterranean formation. The downhole tool is deployable into the wellbore on a drill string. The downhole tool includes a drill bit and a bottom hole assembly with the downhole measurement assembly. The downhole measurement assembly includes at least one drill collar having at least one compensation portion and at least one force portion with a load path therethrough. The compensation portion has a different dimension from the force portion. The assembly also includes a plurality of compensation sensors positionable about the compensation portion to measure downhole tool pressures applied thereto, and a plurality of force sensors positionable about the force portion to measure downhole forces applied thereto. The compensation sensors and the force sensors are positionable about the drill collar in a strain configuration along the load path whereby the measured downhole tool pressure is isolatable from the measured downhole forces on the at least one drill collar.

The downhole tool may also include a surface unit operatively connectable to the downhole measurement assembly, a downhole unit operatively connectable to the downhole measurement assembly, and/or a logging while drilling tool. The drill collar may include a plurality of drill collars, with the compensation portion about a first of the drill collars and the force portion about a second of the drill collars.

Finally, in another aspect, the disclosure relates to method of measuring downhole parameters of a downhole tool positionable in a wellbore penetrating a subterranean formation. The method involves deploying the downhole tool into the wellbore on a drill string. The downhole tool includes a downhole measurement assembly with at least one drill collar having at least one compensation portion and at least one force portion with a load path therethrough. The compensation portion has a different dimension from the force portion. The downhole tool also includes a plurality of compensation sensors positioned about the compensation portion and a plurality of force sensors positioned about the force portion. The compensation sensors and the force sensors are positioned about the drill collar in a strain configuration along the load path. The method further involves measuring downhole tool pressures with the compensation sensors, measuring downhole forces with the force sensors, and isolating the measured downhole forces from the measured downhole tool pressures.

The method may also involve analyzing at least one of the measured downhole tool pressures, the measured downhole forces and the isolated measured downhole forces, and/or measuring additional downhole parameters with at least one additional sensor.

BRIEF DESCRIPTION OF THE DRAWINGS

So that the above recited features and advantages of the present disclosure can be understood in detail, a more particular description of the disclosure, briefly summarized above, may be had by reference to the embodiments thereof that are illustrated in the appended drawings. It is to be noted, however, that the appended drawings illustrate example embodiments of this disclosure and are, therefore, not to be considered limiting of its scope, for the disclosure may apply to other equally effective embodiments. The figures are not necessarily to scale and certain features and certain views of the figures may be shown exaggerated in scale or in schematic in the interest of clarity and conciseness.

FIGS. 3.1 and 3.2 are cross-sectional views of the BHA of FIG. 2 taken at lines 3.1-3.1 and 3.2-3.2, respectively.

FIG. 4 is a schematic illustration of a Wheatstone bridge configuration.

DETAILED DESCRIPTION

The description that follows includes apparatus, methods, techniques, and instruction sequences that embody techniques of the present subject matter. However, it is understood that the described embodiments may be practiced without these specific details.

Despite such advancements in downhole measurements, there remains a need for techniques for obtaining accurate downhole measurements. The present disclosure relates to techniques for measuring downhole force parameters, such as weight on bit (WOB), torque on bit (TOB), axial tension, and axial compression, or any other downhole force applied to the downhole tool. Such downhole forces may be the result of various conditions, such as weight of the downhole tool, a force applied from the surface (e.g., hook load), downhole pressures, etc. In some cases, forces on the downhole tool resulting from downhole pressure ("downhole tool pressures") may be isolated from other downhole force parameters. Such downhole tool pressure may include pressure from, for example, hydrostatic head and different pump pressures that create stress on mechanical portions of the downhole tool. Sensors, such as strain gauges, may be positioned along the BHA in a strain (e.g., Wheatstone bridge) configuration to take downhole force measurements that compensate for the downhole tool pressures.

Figure 1:
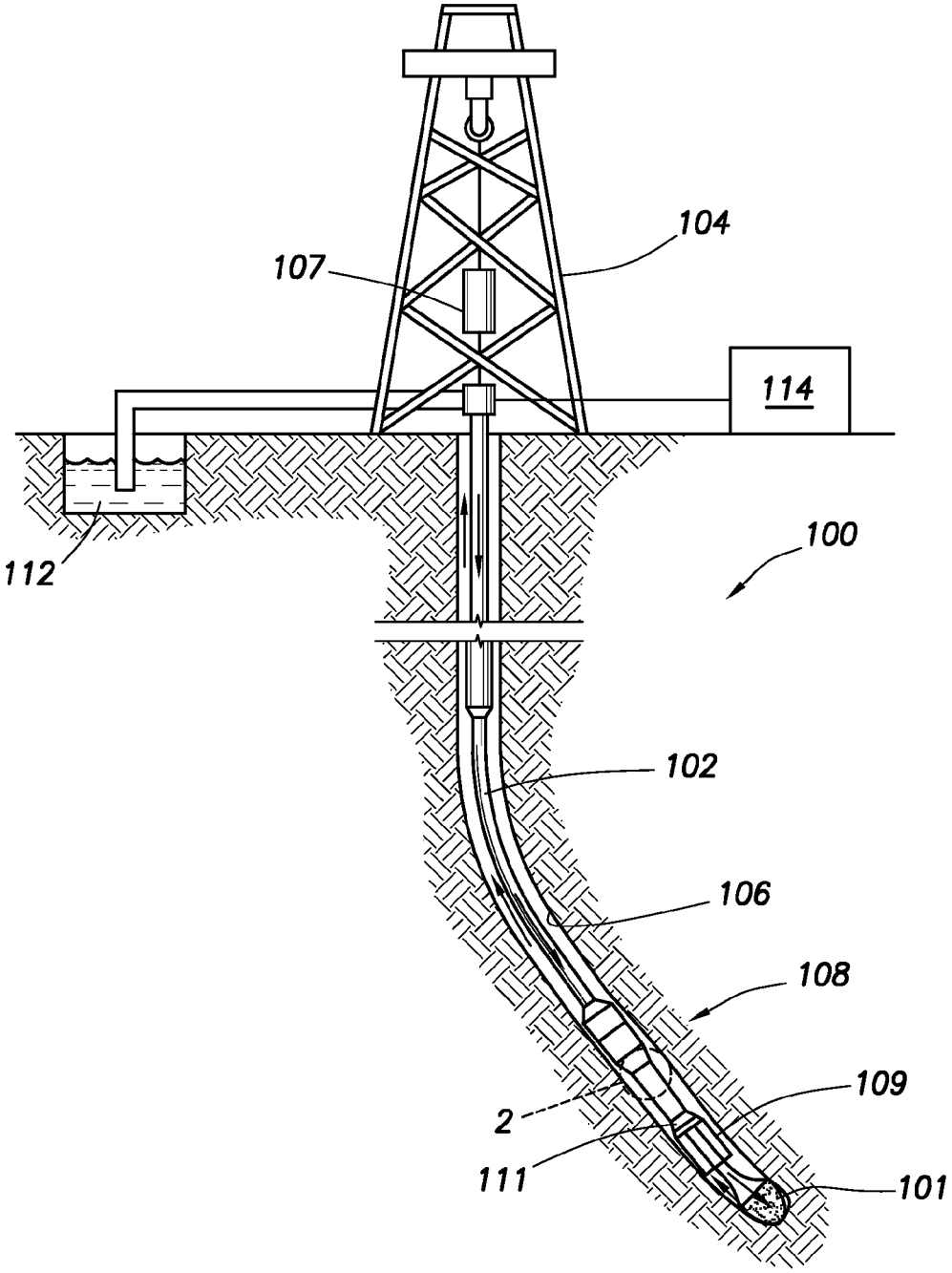
FIG. 1 is a schematic view, partially in cross-section, of a drill rig having a downhole tool including a drill string, a bottom hole assembly (BHA), and a drill bit advanced into the earth to form a wellbore.

FIG. 1 shows schematically a representation of a downhole tool 100 comprising a drill string 102 and a drill bit 101 on a lower end thereof. The drill string 102 is suspended from a derrick 104 for drilling a wellbore 106 into the earth. A hook load 107 may be applied to the drill string 102 from the surface. A bottom-hole assembly (BHA) 108 is located near a lower end of the drill string 102 above the drill bit 101. The BHA 108 may have a drilling motor 109 with a downhole measurement assembly 111 in accordance with the disclosure.

A drilling mud (or fluid) is pumped from a mud pit 112 and through the drill string 102 as indicated by the arrows. The drilling motor 109 is used to rotate and advance the drill bit 101 into the earth. The drilling mud passing through the drilling motor 109, exits the drill bit 101, returns to the surface, and is re-circulated through the drill string 102 as indicated by the arrows. A surface unit 114 may also be provided at the surface and linked to the drill string 102 for communication with the BHA 108.

While FIG. 1 depicts a certain wellsite configuration with a downhole tool 100 deployed from a rig into a wellbore, the downhole tool may be any one of numerous types and may be in any configuration known to those skilled in the drilling industry. For example, the downhole tool may be used in land-based or offshore configuration. There are numerous arrangements and configurations possible for drilling wellbores into the earth. The depictions provided are is not intended to be limited to a particular configuration.

Figure 2:
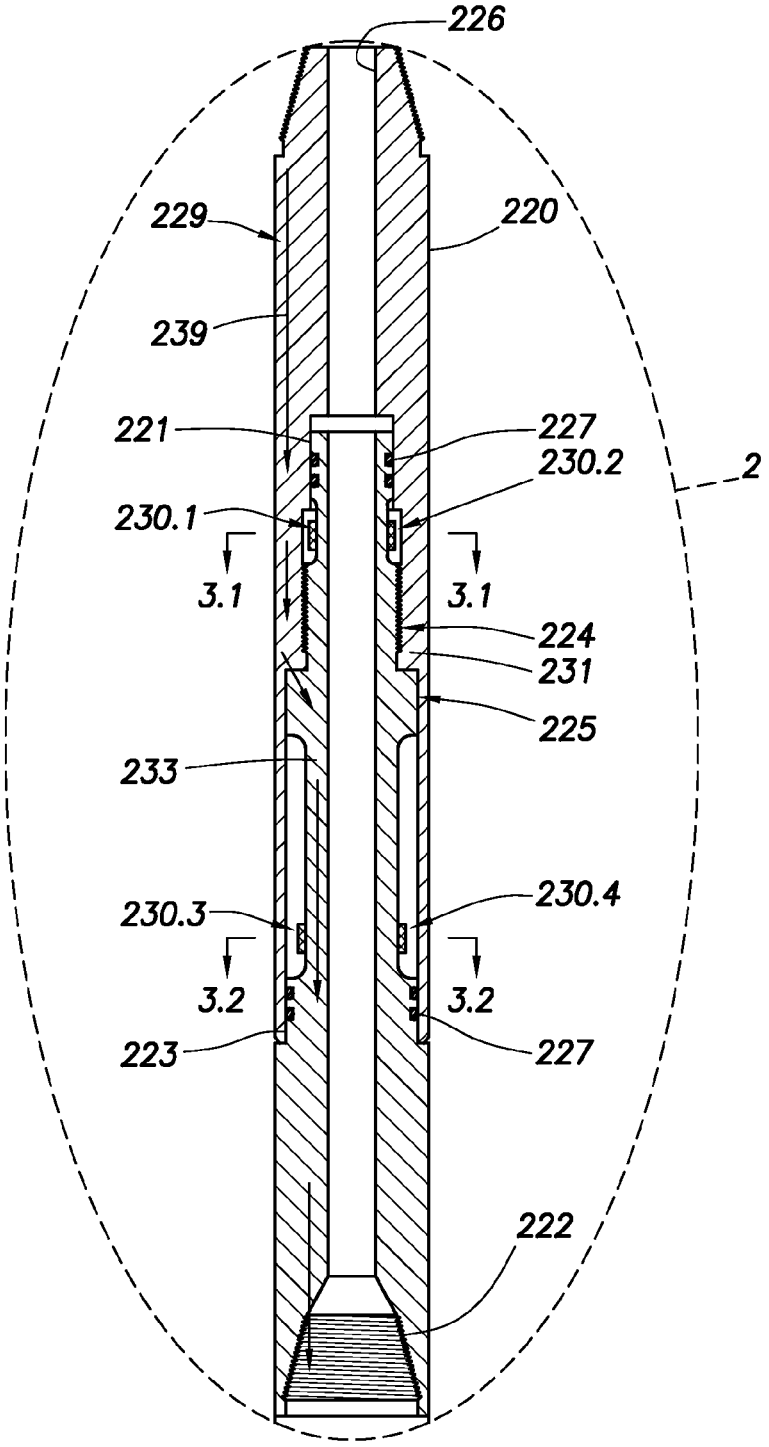
FIG. 2 is a schematic view of a portion 2 of the BHA of FIG. 1 depicting a downhole measurement assembly.

FIG. 2 depicts a portion 2 of the BHA 108 of FIG. 1. The portion 2 includes a pair of drill collars 220 and 222 having a threaded connection 224 therebetween. The drill collars 220, 222 may be threadedly connected to other portions of the BHA 108 and/or the drill string 102 of FIG. 1. The drill collars 220, 222 have a channel 226 for passing drilling fluid therethrough.

The drill collars 220 and 222 are mated such that a male end (or first portion) 221 of drill collar 222 is positioned in a female end 223 of drill collar 220 in a piston/cylinder configuration. Seals (e.g., or-rings or gaskets) 227 are positioned about the male end 221 and the female end 223. Shoulder 225 is on drill collar 222 to seat against a corresponding shoulder 231 on the drill collar 220. The male end 221 may act as a piston within the female end 223 which acts as a cylinder as forces are applied to the drill collars 220 and 222 and movement occurs therebetween.

As indicated by the arrows passing through the drill collars 220, 222, a load path 229 is depicted along the BHA 108. The load path 229 represents the downhole force applied through the drill collars 220, 222 as the BHA 108 is advanced into the wellbore 106 during operation (FIG. 1). The load path 229 extends through the drill collar 220, through the threaded connection 224, over the shoulder 225, and through the drill collar 222. The load path 229 may not pass through the seals 227.

Sensors 230.1-230.4 are positioned about the drill collars 220, 222. The drill collars 220, 222 may be provided with cavities for receiving and supporting the sensors 230.1-230.4. The sensors 230.1-230.4 may be conventional strain gauges supportable by a drill collar and capable of measuring the downhole force parameters. Examples of strain gauges are described in U.S. Pat. Nos. 6,802,215 and 6,957,575, the entire contents of which are hereby incorporated by reference. Other sensors and/or gauges may also be provided about the downhole tool including, but not limited to strain gauges, accelerometers, magnetometers and directional sensors.

The sensors 230.1 and 230.2 are compensation sensors at a first depth $D_1$ positioned on drill collar 222 near the male end 221. Various numbers of sensors may be positioned at depth $D_1$ in various radial positions about the drill collar 222. In the configuration depicted, the pair of sensors 230.1 and 230.2 is positioned at depth $D_1$ at positions on opposite sides of the drill collar 222. As shown in FIG. 2 and as further depicted in the cross-sectional view taken along line 3.1-3.1 as shown in FIG. 3.1, but with drill collar 220 removed, the male end 221 has a given shape, diameter $\phi_1$, and thickness $t_1$. The diameter of the male end 221 may be adjusted to define a force platform for measurement by the sensors 230.1 and 230.2.

Referring back to FIG. 2, the sensors 230.3 and 230.4 are force sensors at a second depth $D_2$ positioned on a base (or second) portion 233 of the drill collar 222 near the female end 223 of the drill collar 220. Various numbers of sensors may be positioned at depth $D_2$ in various radial positions about the drill collar 222. In the configuration depicted, the pair of sensors 230.3 and 230.4 is positioned at depth $D_2$ at positions on opposite sides of the drill collar 222. As shown in FIG. 2 and as further depicted in the cross-sectional view taken along line 3.2-3.2 as shown in FIG. 3-2, but with the drill collar 220 removed, the base portion 233 has a given shape, diameter $\phi_2$, and thickness $t_2$. The diameter of the base portion 233 may be adjusted to define a force platform for measurement by the sensors 230.3 and 230.4.

The position of the sensors at depths $D_1$ and $D_2$ may be aligned, offset, or otherwise positioned for performing the desired measurements. The diameter of the male end 221 and/or the base portion 223 may also be adjusted to alter the measurement taken by the sensors 230.1-230.4. As shown in FIGS. 2, 3.1 and 3.2, the shape of the drill collar 222 at the first depth $D_1$ is different from the shape of the drill collar 222 at the second depth $D_2$. The shape of each of the drill collars 220, 222 may be configured such that the sensors 230.1 and 230.2 will receive forces thereon that are different from the forces received by sensors 230.3 and 230.4. These figures depict an example configuration to provide and/or isolate different downhole forces. The sensors 230.1-230.4 may be positioned at one or more depths and locations about the downhole tool to selectively take the desired measurements.

The sensors may also be positioned and configured to selectively isolate, eliminate and/or reinforce certain portions of the downhole force measurements, such as WOB and/or downhole tool pressures. Certain strain gauges may measure weight applied to the downhole tool (e.g., WOB) and/or downhole tool pressure based on the mechanical geometry and strain gauge placement. By way of example, the sensors may be positioned along the load path 229 in such a manner as to isolate the downhole tool pressures from the other downhole force measurements.

The drill collars 220, 222 may be designed in such a way that the cross-section of the BHA 108 at depth $D_1$ gets loaded with downhole tool pressures. The drill collars 220, 222 may also be designed in such a way that the cross-section of the BHA 108 at depth $D_2$ gets loaded with the WOB and the downhole tool pressure. The relative cross-sections may also be defined such that the piston areas at depths $D_1$ and $D_2$ are different, but measure the same downhole tool pressure. In other words, the configuration is provided such that strain due to downhole tool pressure at $D_1$ equals the strain due to downhole tool pressure at $D_2$. Such pressure may be equal at hydrostatic pressure. This configuration may be used, for example, to isolate the downhole forces from hydrostatic pressure.

While FIGS. 2, 3.1 and 3.2 depict two drill collars 220, 222 having compensation sensors 230.1, 230.2 along a compensation portion at D1 and force sensors 230.3, 230.4 along a force portion at D2, one or more sensors may be positioned to achieve the desired measurements. For example, one or more drill collars with one or more compensation portions and one or more force portions may be provided for receiving the compensation and force sensors, respectively. The compensation and force sensors may be offset about the one or more drill collars to achieve the desired measurements.

With the cross-sections at $D_1$ and $D_2$ optimized for the same strain under downhole tool pressure, the sensors 230.1-230.4 may be positioned in a strain configuration 442 as shown in FIG. 4. The strain configuration 442 may be linked to a downhole unit 414 and/or surface unit 114 for data collection and/or communication therewith. The downhole unit 414 may be positioned in the downhole tool, for example, as part of a logging while drilling or measurement while drilling system. Data from the sensors 230.1-230.4 may be passed to the downhole unit 414 and the surface unit 114 for processing, storage, transfer, analysis, etc.

The strain configuration 442 may be defined so that sensors 230.1 and 230.2 are on a portion of the drill collar 220 that is loaded with a desired downhole force measurement, such as the downhole tool pressure at $D_1$. Sensors 230.3 and 230.4 may be on the section that is loaded with another desired force measurement, such as the downhole tool forces at D2. As shown, the strain configuration 442 is a Wheatstone bridge configuration designed to isolate certain downhole forces. Using the schematic circuit design of the Wheatstone bridge configuration 442, the downhole tool pressure measured by the sensors 230.1 and 230.2 may be subtracted out from the measurement of the sensors 230.3 and 230.4 such that all that remains is the desired downhole force measurement without the downhole tool pressure.

The strain configuration 442 may be, for example, a Wheatstone bridge configuration capable of isolating certain downhole measurements, such as hydrostatic pressure, loads or other forces. The isolated measurements may then be selectively manipulated to determine desired measurements, such as WOB, on the downhole tool.

Figure 5:
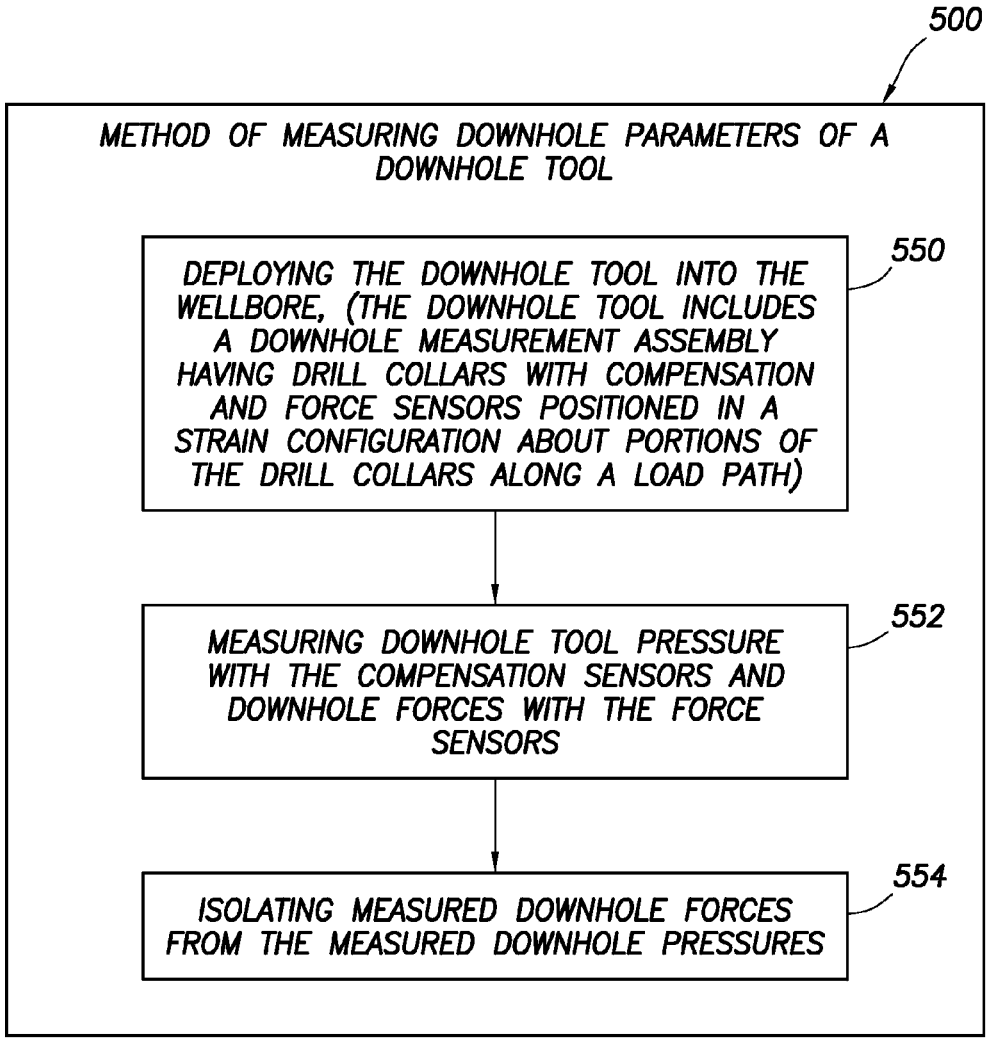
FIG. 5 is a flow chart depicting a method of measuring downhole parameters of a downhole tool.

FIG. 5 depicts a method 500 of measuring downhole parameters of a downhole tool. The method involves deploying (550) the downhole tool into the wellbore on a drill string. The downhole tool includes a downhole measurement assembly including at least one drill collar having at least one compensation portion and at least one force portion with a load path therethrough. The at least one compensation portion has a different dimension from the at least one force portion. The assembly also includes a plurality of compensation sensors positioned about the compensation portion and a plurality of force sensors positioned about the force portion. The compensation sensors and the force sensors positioned about the drill collar in a strain configuration along the load path.

The method also involves measuring (552) downhole tool pressures with the compensation sensors and measuring downhole forces with the force sensors, and isolating (554) the measured downhole forces from the measured downhole tool pressures. The isolating may involve removing (e.g., subtracting) the measured downhole tool pressure from the measured forces on the downhole tool. Other activities may be performed, such as analyzing, processing and storing the measurements. The method may be repeated as desired and performed in any order.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code.

The precise forms of the program storage device and of the encoding of instructions are immaterial here. Aspects of the disclosure may also be configured to perform the described functions (via appropriate hardware/software) solely on site and/or remotely controlled via an extended communication (e.g., wireless, internet, satellite, etc.) network.

While the embodiments are described with reference to various implementations and exploitations, it will be understood that these embodiments are illustrative and that the scope of the inventive subject matter is not limited to them. Many variations, modifications, additions and improvements are possible. For example, one or more strain sensors may be positioned in various strain configurations about the downhole tool for isolating desired downhole measurements. Additional sensors or other components (e.g., downhole and surface units, processors, transceivers, communication devices, etc.) may be provided to facilitate measurement and/or analysis.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A downhole measurement assembly of a downhole tool positionable in a wellbore penetrating a subterranean formation, the downhole tool comprising a bottomhole assembly with a drill bit at an end thereof deployable into the wellbore on a drill string, comprising:

at least one drill collar having at least one compensation portion and at least one force portion with a load path therethrough, the at least one compensation portion having a different dimension from the at least one force portion;

a plurality of compensation sensors positionable about the at least one compensation portion to measure downhole tool pressures applied thereto, wherein the plurality of compensation sensors are positioned a distance from the load path such that the plurality of compensation sensors are isolated from a load applied to the at least one force portion; and a plurality of force sensors positionable about the at least one force portion to measure downhole forces applied thereto;

wherein the plurality of compensation sensors and the plurality of force sensors are positionable about the at least one drill collar in a strain configuration along the load path whereby the measured downhole tool pressure is isolatable from the measured downhole forces on the at least one drill collar.

2. The downhole measurement assembly of claim 1, wherein the strain configuration comprises a Wheatstone bridge.

3. The downhole measurement assembly of claim 1, wherein the plurality of force sensors are at a force depth about the at least one force portion and the plurality of compensation sensors are at a compensation depth about the at least one compensation portion.

4. The downhole measurement assembly of claim 1, wherein the plurality of force sensors and the plurality of compensation sensors are strain gauges.

5. The downhole measurement assembly of claim 1, wherein the at least one drill collar comprises a plurality of drill collars, the plurality of compensation sensors positionable about a first of the plurality of drill collars and the plurality of force sensors positionable about a second of the plurality of drill collars.

6. The downhole measurement assembly of claim 5, wherein the compensation sensors are positionable between the first and the second of the plurality of drill collars.

7. The downhole measurement assembly of claim 5, wherein the force sensors are positionable between the first and the second of the plurality of drill collars.

8. The downhole measurement assembly of claim 5, wherein the force sensors are positionable about an outer surface of the second of the plurality of drill collars.

9. The downhole measurement assembly of claim 5, further comprising gaskets between the plurality of drill collars.

10. The downhole measurement assembly of claim 1, wherein the plurality of compensation sensors are positionable on opposite sides of the at least one drill collar and wherein the plurality of force sensors are positionable on opposite sides of the at least one drill collar.

11. The downhole measurement assembly of claim 1, wherein the plurality of compensation sensors and the plurality of force sensor are aligned about the at least one drill collar.

12. The downhole measurement assembly of claim 1, wherein the compensations sensors and the force sensors are offset about the at least one drill collar.

13. The downhole measurement assembly of claim 1, wherein the at least one drill collar has a plurality of cavities for receiving the plurality of compensation sensors and the plurality of force sensors.

14. The downhole measurement assembly of claim 1, wherein the at least one drill collar comprises a first drill collar and a second drill collar, the first drill collar having a female end matingly connectable to a male end of the second drill collar.

15. The downhole measurement assembly of claim 14, wherein the second drill collar has a male shoulder engageable with a female shoulder of the second drill collar.

16. The downhole measurement assembly of claim 15, wherein the second drill collar has a first cavity and a second cavity on an outer surface thereof with the male shoulder therebetween, the compensation sensors positionable in the first cavity and the force sensors positionable in the second cavity.

17. The downhole measurement assembly of claim 14, further comprising a seal between the first and second drill collars.

18. The downhole measurement assembly of claim 1, wherein the at least one drill collar comprises a piston drill collar receivable into a cylinder drill collar and movable therein in response to forces applied thereto.

19. The downhole measurement assembly of claim 14, further comprising a threaded connection between the first and second drill collars.

20. The downhole measurement assembly of claim 19, wherein the threaded connection is between the male shoulder and a tip of the first drill collar.

21. A downhole tool positionable in a wellbore penetrating a subterranean formation, the downhole tool deployable into the wellbore on a drill string, comprising:

a drill bit;

a bottom hole assembly comprising a downhole measurement assembly, the downhole measurement assembly comprising:

at least one drill collar having at least one compensation portion and at least one force portion with a load path therethrough, the at least one compensation portion having a different dimension from the at least one force portion;

a plurality of compensation sensors positionable about the at least one compensation portion to measure downhole tool pressures applied thereto; and a plurality of force sensors positionable about the at least one force portion to measure downhole forces applied thereto, wherein the plurality of compensation sensors are positioned a distance from the load path such that the plurality of compensation sensors are isolated from a load applied to the at least one force portion;

wherein the plurality of compensation sensors and the plurality of force sensors are positionable about the at least one drill collar in a strain configuration along the load path whereby the measured downhole tool pressure is isolatable from the measured downhole forces on the at least one drill collar.

22. The downhole tool of claim 21, further comprising a surface unit operatively connectable to the downhole measurement assembly.

23. The downhole tool of claim 21, wherein the bottom hole assembly further comprises a downhole unit operatively connectable to the downhole measurement assembly.

24. The downhole tool of claim 21, wherein the bottom hole assembly further comprises a logging while drilling tool.

25. The downhole tool of claim 21, wherein the at least one drill collar comprises a plurality of drill collars, the compensation portion about a first of the plurality of drill collars and the force portion about a second of the plurality of drill collars.

26. A method of measuring downhole parameters of a downhole tool positionable in a wellbore penetrating a subterranean formation, comprising:

deploying the downhole tool into the wellbore on a drill string, the downhole tool comprising a downhole measurement assembly, comprising:

at least one drill collar having at least one compensation portion and at least one force portion with a load path therethrough, the at least one compensation portion having a different dimension from the at least one force portion; and a plurality of compensation sensors positioned about the at least one compensation portion and a plurality of force sensors positioned about the at least one force portion, the plurality of compensation sensors and the plurality of force sensors positioned about the at least one drill collar in a strain configuration along the load path, wherein the plurality of compensation sensors are positioned a distance from the load path such that the plurality of compensation sensors are isolated from a load applied to the at least one force portion;

measuring downhole tool pressures with the plurality of compensation sensors and measuring downhole forces with the plurality of force sensors; and isolating the measured downhole forces from the measured downhole tool pressures.

27. The method of claim 26, further comprising analyzing at least one of the measured downhole tool pressures, the measured downhole forces and the isolated measured downhole forces.

28. The method of claim 26, further comprising measuring additional downhole parameters with at least one additional sensor.

* * * * *